United States Patent [19]

Vaders

[11] Patent Number: 4,569,548

[45] Date of Patent: Feb. 11, 1986

[54] REMOTELY RELEASABLE CHOKER

[75] Inventor: Dennis H. Vaders, Plymouth, N.C.

[73] Assignee: Weyerhaeuser Company, Tacoma, Wash.

[21] Appl. No.: 633,746

[22] Filed: Jul. 23, 1984

[51] Int. Cl.[4] ..... B66C 1/38

[52] U.S. Cl. ..... 294/82.14; 294/82.3; 294/82.34; 294/905

[58] Field of Search ..... 294/75, 82.14, 82.24, 294/82.25, 82.27, 82.29–82.31, 82.34, 905; 24/238, 239, 241 P, 241 PS, 241 SL

[56] References Cited

U.S. PATENT DOCUMENTS

| | | | |
|---|---|---|---|
| 308,219 | 11/1884 | Washburn | 24/241 PS |
| 1,477,836 | 12/1923 | McGowan | 294/82.34 |
| 3,104,909 | 9/1963 | Walker | 294/75 |
| 4,185,864 | 1/1980 | Phillips et al. | 294/82.3 |
| 4,417,758 | 11/1983 | Vaders | 294/82.14 |

*Primary Examiner*—Johnny D. Cherry

[57] ABSTRACT

An improvement in a remotely controlled hook assembly that has a body with an eye and a releasable latch arm together with a slidable pin for locking the latch arm includes a cam surface mounted on the latch arm. The cam is in line and engagable with the bottom end of the slidable pin such that when the pin is to be moved to its uppermost position and locked, the operator merely rotates the latch arm using it as a lever arm to move the pin upwardly until it is locked in place.

2 Claims, 3 Drawing Figures

REMOTELY RELEASABLE CHOKERBACKGROUND OF THE INVENTION

This invention relates generally to log handling systems for use in the woods or other elongated object handling systems, but more particularly to a remotely controlled choker hook and release system. Even more particularly, it relates to an improvement to the choker assembly as disclosed in U.S. Pat. No. 4,417,758 assigned to the assignee of the present invention.

It is common practice in woods operations where trees are being harvested and logs moved about to utilize cable handling systems either at ground level or overhead yarding systems. As a part of these log handling systems, steel cables are wrapped about felled trees to form a noose or choker. The cable, once looped around a tree or a plurality of trees, is attached back onto itself, using a special device referred to as a choker hook which allows the loop to tighten about the tree. The tightened loop serves to hold it as the cable is then tensioned to lift the tree and pull it to the desired location. Once the logs arrive at the desired location, the choker must than be released in order to release the tree. The typical way chokder hooks are now released is by manual labor, physically releasing the choker hook after the cable is slackened and the loop removed from the tree. Not only is the job of releasing the chokers extremely dangerous, but it takes time and delays production.

In the past, others have designed remotely controlled selfreleasing choker mechanisms and one such example may be seen by referring to U.S. Pat. No. 3,104,909 issued in 1963 to W. M. Walker. In the Walker patent, a choker hook is disclosed where the end of a cable has a ferrule affixed to it which is seated and held within the choker hook casing. A pivotally mounted locking arm is controlled in part by a servo for holding and releasing the end of the cable. The choker assembly of U.S. Pat. No. 4,417,758 represented an improved design over Walker and now the present invention represents an improvement over the design disclosed in U.S. Pat. No. 4,417,758. In the remotely releasable choker of U.S. Pat. No. 4,417,758, a latch arm has an open and a locked position with the means for locking the arm including, in one embodiment, a slidable latch pin that engages an aperture in the latch arm. In woods use, the operator was required to "cock" the choker by pushing the latch pin up with the thumb against a stiff spring. This cocking step has been found to be inconvenient and also results in sore thumb muscles at the end of a normal shift.

Accordingly from the foregoing, one object of the present invention is the provision of a low cost mechanism to improve the locking means of the choker disclosed in U.S. Pat. No. 4,417,758.

Another object of the invention is to provide an improved locking mechanism that reduces fatigue of the operator.

These and other objects of the invention will be better understood and appreciated upon a thorough review of the specification to follow in conjunction with the attached drawings.

BRIEF SUMMARY OF THE INVENTION

Briefly, this invention is practiced in one form by a choker hook which is self-contained in a housing or body having means on one side for allowing a cable to slide therethrough and having on another side external to the choker housing a pivotally releasable latch arm for securing and releasing the end of a cable grasped by the choker hook. Within the choker housing and well protected is a slidably mounted pin extending through the housing and upwardly so as to engage an aperture in the latch arm for locking purposes. An internal release mechanism has means associated therewith for causing the slidable pin to move downwardly out of the aperture, thereby releasing the latch arm and the end of the cable. The release means may include a servo or solenoid activated rotating catch which either supports the pin in its upward position or rotates to remove the support, thereby allowing the pin to retract. A radio receiver, battery pack, and servo are all packaged withing the housing. A switch is located in the housing adjacent to the slidable pin and when the latch arm is to be closed and locked in position, the pin is moved upwardly closing the switch, thereby signalling the drive means for the catch to move and position the support means to a position under a shoulder on the slidable pin. The slidable pin can be structured so as to be spring loaded to allow the upper end of the latch arm to ride over it, thereby allowing the slidable pin to engage the aperture in the latch arm.The specific improvement comprising the present invention is a slidable pin cocking cam mounted on the bottom portion of the latch arm and operatively associated with the slide pin such that the latch arm acts as a cocking lever arm for easily locking the slide pin in its uppermost position when the cam engages the bottom of the slidable pin and is moved upwardly by the latch arm acting as a lever arm for the operator.

DETAILED DESCRIPTION OF THE PREFERRED EMBODIMENT

Figure 1:
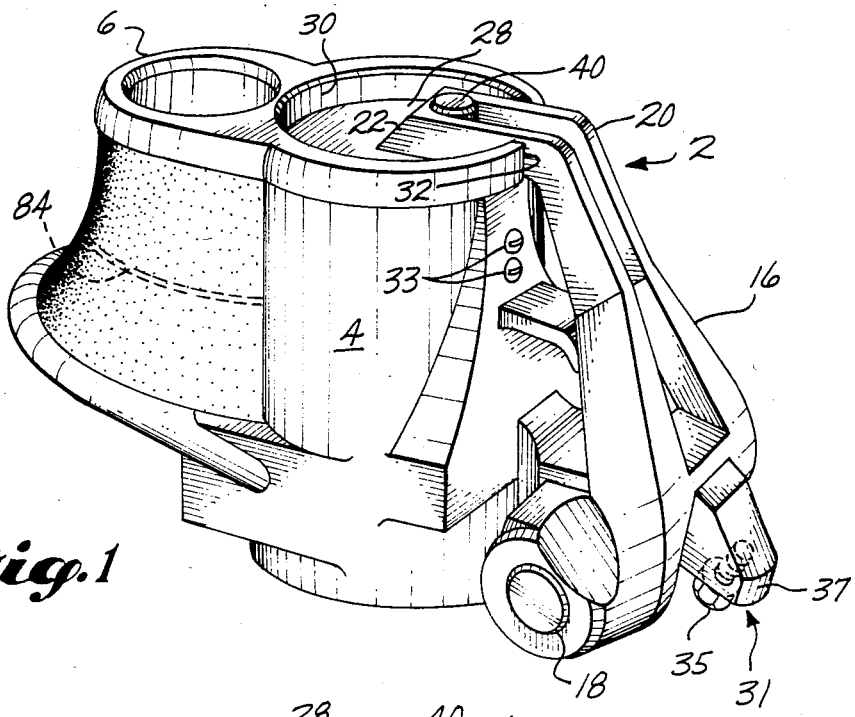
FIG. 1 is an isometric view showing the choker hook structured according to the present invention.
Figure 2:
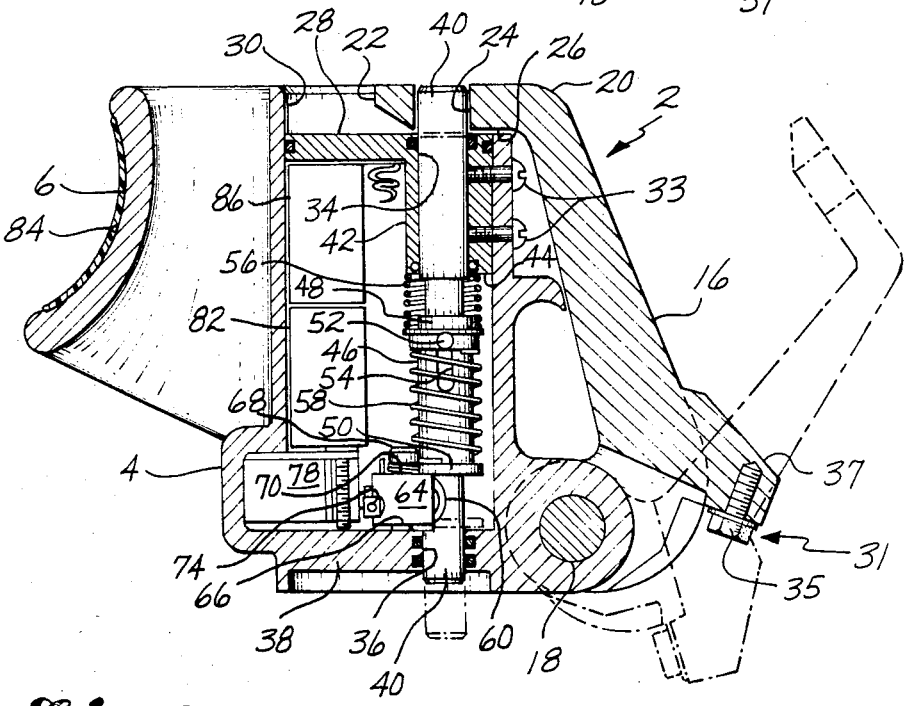
FIG. 2 is a side elevation view in cross section showing the latch arm in the locked and partially opened positions.

Referring first to FIGS. 1 and 2, the choker hook is indicated at 2 and includes a generally cylindrical housing or body 4. On one side of housing 4 is an eye means 6 which provides part of the means for forming a typical choker loop from cable material. Such cables and their end attachments are well known and need not be described in any detail. Further, as will be well understood by those skilled in the art, it is the loop, which when formed by the cable and choker hook 2, that will be positioned about a log, grouping of logs, or other elongated objects and then cinched tight for handling purposes. As tension is applied to the cable, the loop is closed tight about the object, thereby allowing it to be moved to a desired location. The disclosure of U.S. Pat. No. 4,417,758 is hereby incorporated by this reference to provide a complete description of the present invention.

On another side of housing 4 is the pivotally mounted latch arm 16. Latch arm 16 may be substantially U-shaped and is attached to body 4 at pivotal means 18. The arm 16 extends upwardly and has a bend 20 terminating at its upper end 22. Between bend 20 and upper end 22 is an aperture 24 extending through arm 16. Aperture 24 can be of any suitable cross-sectional shape although in the embodiment depicted it is substantially circular. The bottom surface 26 of upper end 22 is structured and sized so as to lie substantially parallel to the top covering element 28 of cylindrical body 4. Covering element 28 is positioned a small distance downwardly from the top edge of body 4, thereby developing a rim 30 on the top of the choker hook 2. In order to accommodate the upper end 22 of latch arm 16, an opening 32 is located in rim 30, with the opening being slightly larger in its width dimension than the width of upper end 22, allowing the latch arm to fit in the opening.

Latch arm 16 and its pivotal means 18 are constructed so as to be strong and for an even distribution of stresses. When latch arm 16 is locked in position and the choker hook 2 is under stress, a significant amount of force will be applied downwardly in the area about pivotal means 18; therefore, it must be constructed of high strength materials and also with a sufficient amount of material.

Figure 3:
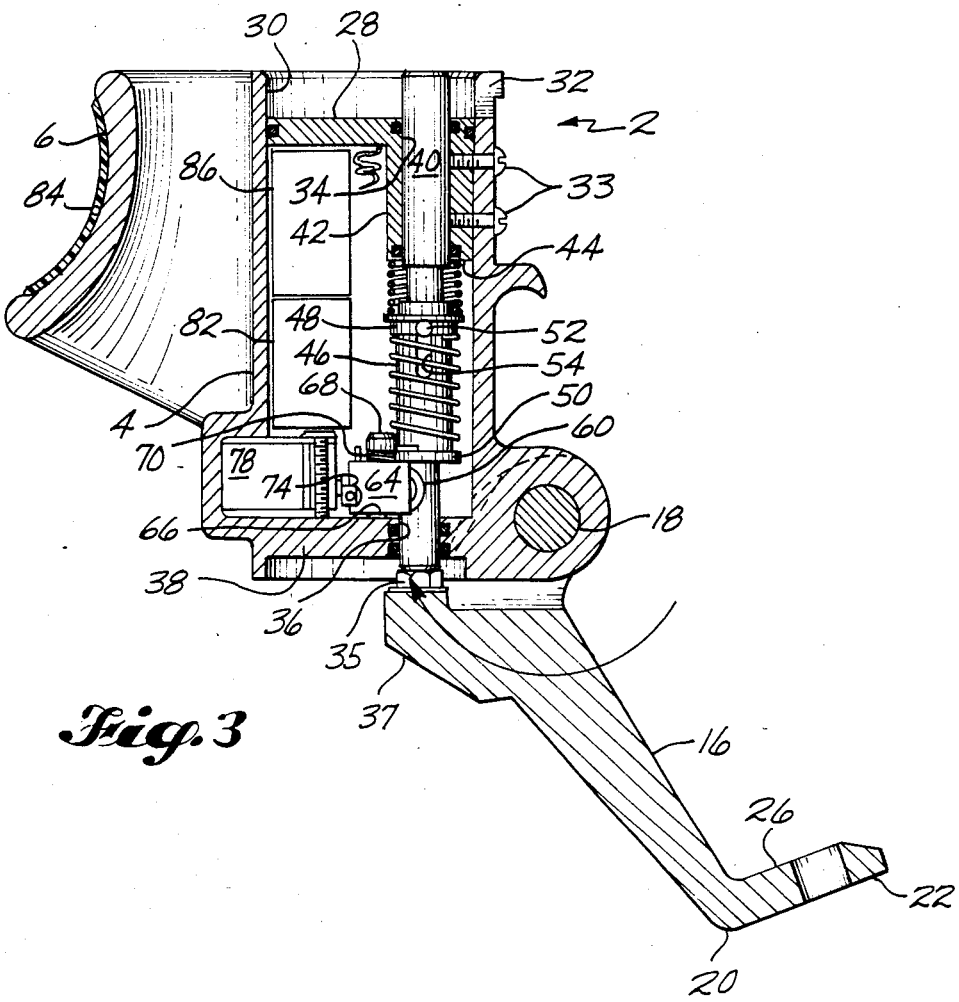
FIG. 3 is a view similar to FIG. 2 showing the latch arm fully extended and acting as a lever arm to move the slidable pin to its uppermost position.

At a location on latch arm 16 toward the bottom end but spaced from pivotal means 18 is cocking cam means 31. Cocking cam 31 may either be an integral piece on arm 16 or, as shown in the figures, it can be an adjustable bolt 35 turned into a protruding base 37. As seen in FIGS. 2 and 3, the cam means 31 is spaced laterally from the pivotal means 18 approximately the same spacing that exists between the pivotal means and the bottom end of latch pin 40. Latch arm 16 is constructed so as to have sufficient swing about pivotal means 18 to allow cam means 31 to engage the bottom of pin 40 when the arm is pulled all the way back toward the full open position. Sufficient height is provided on the cam surface to cause the pin 40 to move upwardly and into its locked position when latch arm 16 is leveraged to the full open position. The internal mechanism that allows pin 40 to become locked in its uppermost position can be substantially similar to that shown in U.S. Pat. No. 4,417,758. Of course, after the pin 40 is locked in place, the operater moves latch arm 16 back and closes the arm over the upper end of pin 40. Latch arm 16 will then be in its locked position.

Referring to FIGS. 2 and 3, a detailed description of the internal latching and control mechanism will be given. It is important to note at this point that the latch arm release and control means must be well protected within a secure environment and must be durable for long life in the harsh environment of logging operations or other heavy duty use. As previously noted, the cylindrical body 4 is constructed of high strength material and can conveniently be cast to the desired shape. For access to the inside of body 4, top covering element 28 is a separate piece attached by screws 33 which can be removed from body 4. Mounted within body 4 and slidable within aperture 34 in covering element 28 and aperture 36 within the bottom covering element 38 is latch pin 40. Depending downwardly from covering element 28 and integral therewith is bearing lug 42 having a bottom surface 44. Lug 42 extends approximately one-third to one-half the distance between top covering element 28 and bottom covering element 38. The upper end of pin 40 is structured so as to fit within aperture 24 when it is in registry with aperture 34. Both ends of pin 40 are rounded or at least chamfered. Further, the length of pin 40 is sized so its overall length will be approximately equal to the distance between the bottom surface of bottom covering element 38 and the uppermost surface on the upper end 22 on latch arm 16.

Positioned about latch pin 40 and slidable relative to it is the sliding collar body 46. As may be clearly seen in the Figures, collar 46 is located on the bottom half of pin 40 and further has a pair of vertically spaced circumferential shoulders, the top one being indicated at 48 and the bottom one being indicated at 50. Limiting the vertical movement of collar 46 is through pin 52 fixed to the latch pin 40 and extending through the pin slot 54 on either side of collar body 46. The length of slots 54 corresponds to the length of pin 40 that extends upwardly through aperture 24 when the latch arm is locked in place. Serving to provide, in part, the various movements for pin 40 is a pair of compressible coil springs with one indicated at 56 being mounted about pin 40 and extending between the top circumferential edge of shoulder 48 and the bottom of surface 44. The other spring 58 is mounted about collar 46 and extends between the lower circumferential edge of bottom shoulder 50 and the bottom edge of through pin 52. Functionally, upper spring 56 provides the downward movement for latch pin 40 when the latch arm 16 is to be released. Lower spring 58 provides an upward biasing force so that, when latch arm 16 is closed, pin 40 can be biased downwardly.

Serving to hold pin 40 in its upwardly extended position, thereby holding latch arm 16 in its locked position, and to release it is a roller bearing 60 which is movable in a horizontal plane with respect to pin 40 from a first position out of engagement with bottom shoulder 50 to a second position engaging the bottom surface of shoulder 50, thereby holding shoudler 50 in place along with collar 46 and pin 40.

Bearing 60 is mounted on a support arm (not shown), which in turn is fixedly attached to a rotatable catch member 64. Rotatable member 64 is mounted on bottom covering element 38 by a downwardly extending shoudler screw 66. On the top of screw 66 is a head 68 which retains a torsion spring 70, one end of which is fixed to the top of rotatable member 64, while the other end is held fixed relative to the body 4, either by being pinned or by abutting the inside surface of body 4. Torsion spring 70 serves to aid in moving the rotatable member 64 and, therefore, the roller bearing 60. Extending outwardly from the side of rotatable member 64 is a second arm 74 which serves to provide the attachment means for a servo drive cable (not shown). A servo mechanism indicated at 78 is substantially a commercially available servo and is capable of being activated by appropriately generated signals to rotate an arm (not shown), thereby moving the drive cable linearly. Suitable servo mechanisms are in common use by radio controlled model enthusiasts. A radio receiver indicated at 82 is mounted above servo mechanism 78 and rotatable member 64 and to one side of the latch pin 40. Again, radio receiver 82 is one which is commercially available and functionally is equipped to receive remotely generated radio signals and develop suitable signals for controlling servo mechanism 78. An antenna 84 is mounted in a rugged polymer covering around eye 6. Any suitable antenna means may be utilized, provided it has the capability of receiving the radio signal without being damaged when the choker hook is used. The power supply for operating choker hook 2 is provided by a battery 86 also mounted above rotatable member 64 and to the side of pin 40. Typically, a nickle-cadmium battery will be used due to their rechargeable characteristic and durability.

OPERATION OF THE CHOKER HOOK ASSEMBLY

For use in the woods, the choker loop will first be formed and the loop placed about a log. Once the cable is looped about a log and ferrule positioned between body 4 and latch arm 16, the arm is ready to be closed and locked in position. The operator then moves latch arm 16 upwardly and over the biased pin 40 to its locked position. The cable is tensioned and the loop cinched tight. The log or logs can then be moved to wherever the desired location is. Upon arrival, a transmitter means is used which is set at the right frequency compatable with radio receiver 82 to activate the servo mechanism 78. When logs are in place, the release signal is sent causing rotation of catch member 64, thereby moving roller bearing 60 away from its supporting relationship with bottom shoulder 50. Once the support is gone, upper spring 56 will force the top shoulder 48 down against through pin 52, thereby causing pin 40 to move downwardly. As it reaches the plane of the top surface of covering element 28, latch arm 16 will then be released. Once latch arm 16 is released, the logs will fall free and the cable and choker hook assembly can be retrieved for subsequent use. In order to reset the choker hook for subsequent use, an operator turns the arm 16 causing the cam 31 to engage on the bottom of pin 40. As the operator continues to rotate the arm, the pin begins to move upwardly signaling the servo mechanism to move roller bearing 60 back into engagement with shoulder 50 thereby holding it in its upper extended postion. The operator must continue to hold the latch arm in its extended position with the cam in engagement with the pin to allow sufficient time for the roller bearing to engage. Once pin 40 is in its upper position then the latch arm can be locked in its closed position.

Having described the choker hook assembly and the present improvement in detail and its typical operating procedure, it will occur to others skilled in the art that certain modifications and changes to this improvement can be made. All such changes and modifications are intended to be included within the scope of the appended claims.

I claim:

1. A choker assembly of the type having a substantially closed body with eye means on the body, a pivotally mounted latch arm on the outside of the body having an open position and a locked position, means within the body for holding the latch arm in its locked position including a slidable pin moveable from a lower released position to an upper position where it holds the latch arm, having the improvement comprising:

a cam mounted on the latch arm substantially in line and engagable with the bottom end of the slidable pin and sized to move the slidable pin upwardly to its uppermost position as the latch arm is moved toward its open position.

2. The choker assembly of claim 1 in which the cam includes a protruding base in which an adjustable bolt is mounted.

* * * * *

UNITED STATES PATENT AND TRADEMARK OFFICE

CERTIFICATE OF CORRECTION

PATENT NO. : 4,569,548

DATED : Feb. 11, 1986

INVENTOR(S) : Dennis H. Vaders

It is certified that error appears in the above—identified patent and that said Letters Patent is hereby corrected as shown below:

In column 2, line 15, "withing" should read --within--;

In column 4, line 33, "shoudler" should read --shoulder--;

In column 4, lines 39 and 40, "shou-dler" should read --shoulder--;

Signed and Sealed this

*Nineteenth* Day of *August 1986*

[SEAL]

*Attest:*

DONALD J. QUIGG

*Attesting Officer*

*Commissioner of Patents and Trademarks*